US006263653B1

(12) United States Patent
Mack

(10) Patent No.: US 6,263,653 B1
(45) **Date of Patent: *Jul. 24, 2001**

(54) SPINNING PLANT WITH ROVING FRAMES AND RING-SPINNING FRAMES

(75) Inventor: Karl-Heinz Mack, Weilheim (DE)

(73) Assignee: Zinser Textilmaschinen GmbH, Ebersbach/Fils (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/183,731

(22) Filed: Nov. 2, 1998

(30) Foreign Application Priority Data

Nov. 6, 1997 (DE) ..... 197 49 024

(51) Int. Cl.[7] ..... D01H 9/10
(52) U.S. Cl. ..... 57/281; 57/267; 57/90
(58) Field of Search ..... 57/267, 281, 90

(56) References Cited

U.S. PATENT DOCUMENTS

| | | | | |
|---|---|---|---|---|
| 4,720,967 | * | 1/1988 | Guttler | 57/281 |
| 5,390,868 | * | 2/1995 | Kiriake | 242/35.5 |
| 5,443,217 | * | 8/1995 | Nishikawa et al. | 57/281 |
| 5,509,614 | * | 4/1996 | Nishikawa et al. | 57/281 |
| 5,628,174 | * | 5/1997 | Mack et al. | 57/281 |
| 5,715,669 | * | 2/1998 | Hasegawa et al. | 57/281 |
| 5,724,801 | * | 3/1998 | Kogiso et al. | 57/281 |
| 5,732,542 | | 3/1998 | Mack | 57/281 |
| 5,996,327 | | 12/1999 | Mack | 57/281 |

FOREIGN PATENT DOCUMENTS

| | | |
|---|---|---|
| 37 34 275 | 10/1987 | (DE) . |
| 39 11 799 | 4/1989 | (DE) . |
| 39 41 822 | 6/1991 | (DE) . |
| 40 37 881 A1 | 6/1992 | (DE) . |
| 195 05 050 | 8/1996 | (DE) . |
| 196 01 286 | 11/1996 | (DE) . |
| 197 02 163 | 1/1997 | (DE) . |
| 314 631 | 4/1994 | (EP) . |

* cited by examiner

*Primary Examiner*—Danny Worrell
(74) *Attorney, Agent, or Firm*—Herbert Dubno

(57) ABSTRACT

A spinning plant having one or more roving frames and one or more ring-spinning machines coupled by a common transporter has bobbin/core transfer units equipped with a color sensor which ensures that color coded cores representing particular roving qualities are replaced by full bobbins of the respective quality and vice versa, thereby avoiding problems of feed of the incorrect roving quality to a spinning machine and the winding of roving incorrectly on a color-coded core.

9 Claims, 4 Drawing Sheets

SPINNING PLANT WITH ROVING FRAMES AND RING-SPINNING FRAMES

FIELD OF THE INVENTION

My present invention relates to a spinning plant of the type wherein at least one roving frame and usually a plurality of such roving frames can be operationally coupled with at least one spinning frame, especially a plurality of ring-spinning machines, by an endless circulating transport element, e.g. a track system on which a hanger train can be displaced and from which the bobbins and core sleeves can be suspended.

BACKGROUND OF THE INVENTION

In spinning plants it is customary to provide a number of roving frames having respective stations or spindles at which empty core sleeves are wound from sliver to form respective roving bobbins. The sliver may arrive from conventional can fields and can pass through a drafting frame before reaching the bobbins or core sleeves on which the roving is wound. When the roving bobbins are full, a bobbin replacement operation commences and, for example, a transfer unit may be displaced along the machine or a train of suspended bobbins may be displaced past the transfer unit which serves to remove the full bobbins and replace them with empty core sleeves.

The endless transport element, receiving from such a transfer unit at the roving frames, the full bobbins and delivering empty core sleeves to the roving frames, then carries the full bobbins to one or more ring-spinning frames in which the roving is spun into yarn from the roving bobbins. At the ring-spinning machines, respective transfer units can remove empty core sleeves as the roving is paid out and can replace them with full roving bobbins, the core sleeves being transferred to the transport element for return to the roving frames. The ring-spinning machines can be provided with creels or the like which hold reserve full bobbins or bobbins in use for supplying roving to those stations or for storage of empty core sleeves until the are transferred to the transporter.

It has been found, in such plants, that it is advantageous from time to time to operate with different roving qualities and for that purpose care must be taken to direct roving bobbins of a particular quality to certain ring-spinning machines and, in general, to make it possible to distinguish between roving bobbins in which the roving may be of a different quality at one point in time from another.

In DE 196 01 286, for example, (see also U.S. Pat. No. 5,732,542), each of the roving frames has a respective transfer unit which automatically removes empty core sleeves from a transport element passing by the roving frame and replaces them on that transport element with full roving bobbins. The roving frame supplies roving bobbins of a predetermined roving quality and these bobbins are carried to the ring-spinning machines. For a change in the roving quality, it is necessary to allow the transport element to carry roving bobbins of the "old" quality until all of them have been replaced by roving bobbins of the new quality in a system operating with two roving qualities.

EP 0 314 631 B1 discloses a spinning plant in which two roving frames or machines are associated with a common transporter that carries the roving bobbins of both roving frames to the ring-spinning machines associated therewith and returns the roving sleeves or cores to the roving frames. The two roving frames operate to produce different qualities of roving and the two sets of roving bobbins with their different qualities are simultaneously mounted with the transporter. When the transporter conveys more than a single roving quality, it has been necessary heretofore for service personnel or, where possible, automatic devices to differentiate between them and see that the roving bobbins or roving sleeves are withdrawn from or mounted in the transporter so that the distinction is maintained.

For this purpose, a transfer unit can be provided which removes the empty core sleeves from the transporter and feeds them into the roving frame so that they are again wound with roving bobbins. This type of transfer unit is referred to generally as a roving frame transfer system. It is based upon the condition that the transfer unit of the roving frame will only feed those roving core sleeves to the latter whose color is associated with the roving quality of the roving frame to which those core sleeves are supplied. The transfer unit can also remove full roving bobbins from the transporter and mount them in the creel of a ring-spinning machine. This type of transfer unit is referred to as a ring-spinning machine transfer unit. In this as well the transfer unit should only supply to the ring-spinning machine such roving bobbins as have a core or sleeve color associated with the roving quality to be processed in that ring-spinning machine.

OBJECTS OF THE INVENTION

It is the principal object of the present invention to provide a spinning plant which can more rationally handle a plurality of roving qualities, thereby eliminating drawbacks of earlier systems.

A more specific object of this invention is to provide a spinning plant having two or more roving frames and two or more ring-spinning frames and a common endless transporter traveling between the roving frame side of the system and the spinning frame side thereof, there being provided at least one transfer unit capable of mounting sleeves on the transporter and removing wound bobbins therefrom, which can readily differentiate between different qualities of roving and can route the core sleeves or roving bobbin properly.

Still another object of the invention is to provide a system which can achieve the results described while avoiding drawbacks of prior art systems utilizing core sleeves which are colored in accordance with the roving quality to be formed as bobbins thereon.

SUMMARY OF THE INVENTION

While it has long been known to provide core sleeves on which roving bobbins are to be wound, in different colors with each color being designed to receive a respective roving quality, in general, yarn and roving sleeves or cores have had to be provided with machine readable codes using optical or magnetic means to convey information with respect to the quality of the roving carried thereby. Such codes have not, however, been readily readable visually by service personnel and, as a rule, service personnel have not been able heretofore to readily distinguish between roving qualities at the transfer unit and assure a proper sorting.

The invention, by contrast, allows for such sorting automatically. A spinning plant according to the invention can thus comprise:

- at least one roving frame having a multiplicity of stations for forming roving from sliver and winding roving onto a respective core sleeve at each of the stations and form a respective roving bobbin;
- at least one ring spinning frame having a multiplicity of stations for spinning roving from the bobbins into yarn and emptying roving from the core sleeves of the bobbins;

an endless transport element extending in a closed path between the at least one roving frame and the at least one ring spinning station for carrying roving bobbins to the ring spinning frame from the roving frame and for returning core sleeves from the ring spinning frame to the roving frame, the core sleeves having one of a plurality of different colors representing different roving qualities of roving bobbins to be wound thereon;

at least one automatic transfer unit along the path and provided with means for exchanging core sleeves and roving bobbins on the transport element; and at least one color sensor along the path for automatic scanning of the core sleeves for color and, in dependence upon a detected color, controlling operation of the transfer unit.

Advantageously each of the frames is provided with a respective one of the automatic transfer units and each of the a automatic transfer units is provided with a respective one of the color sensors for controlling the respective transfer unit.

Alternatively, each of the frames is provided with a respective one of the automatic transfer units and a central controller is provided for the frames, the transport element and the automatic transfer units, the color sensor being connected to the controller for operating at least one of the transfer units in response to detection of color of the color-coded core sleeves.

Preferably the color sensor the color sensor is capable of distinguishing between n different colors, whereby n is the number of roving frames serviced by the transport element.

The color sensor can be capable of distinguishing between n+m different colors, whereby n is the number of roving frames serviced by the transport element and m is the number different roving qualities capable of being simultaneously processed in the plant.

With the system of the invention, a service person can determine the quality of the roving on a roving bobbin directly and in systems in which the transfer of the roving bobbin to the creel of the ring-spinning machine is effected by hand, can ensure that only roving bobbins of the correct quality are selected for the particular ring-spinning frame. The transfer unit itself can readily recognize the color of the roving bobbin sleeve associated with a particular quality of roving and bobbin and its associated position on the transporter so that such sleeves are always delivered to the roving frame for winding bobbins of that quality and the position of such a core or sleeve or bobbin on the transporter is reserved for those particular core sleeves and bobbins. Where the roving quality matches, the roving frame transfer unit will ensure that the appropriately colored core sleeves are delivered to the respective roving frame and the bobbins of that quality are applied to the transporter, whereas the ring spinning frame transfer unit will apply only full bobbins of the respective roving quality to the particular ring-spinning unit.

In spite of the numerous roving bobbins and core sleeves which may be transported with the system of the invention, the processing of specific roving qualities will always be effected in ring spinning machines specifically associated with that roving quality.

The color sensor is also applicable even when only a single roving frame is provided and the transporter as a rule is associated with only a single yarn quality as supplied by the roving frame. When in this case, changeover of the roving frame an to roving quality is to be effected, this changeover can be carried out on the fly, i.e. the new roving quality can be transferred to the core sleeves in the roving frame which have had their color altered to reflect the different quality, while roving bobbins of the old quality continue to be advanced along the path of the transporter.

When a roving machine transfer unit, for transferring the full bobbins to the transporter, is provided according to the invention with a color sensor, it can operate on the fly for the removal of the roving bobbins and roving cores or sleeves of the "old" roving quality for replacement by roving bobbins of the "new" roving quality without the intervention of service personnel since the unit can distinguish between the roving qualities.

However, it is also conceivable that the ring-spinning machines serviced by the transporter can be provided to handle one or another of the roving qualities or can be capable of handling two or more roving qualities as supplied by the transporter. The transporter can be supplied by hand with the bobbins or bobbin sleeves or the transfer of the bobbins or bobbin sleeves to and from the transporter at the ring-spinning machine can utilize a stand-alone transfer unit or a mobile transfer unit can be displaced along the ring-spinning machine and along a stretch of the transporter. When the roving bobbins are not delivered to the ring-spinning machine assigned to that quality of the roving, they need merely remain on the transporter. This is assured with the color sensor of the invention.

The color sensor of the invention also has a significant advantage in normal operation since roving sleeves which may have been improperly mounted on the transporter can be recognized by the color sensor and hence a variation in the roving quality during processing and like defects can be avoided.

Especially when the transporter services two or more roving frames which are capable of supplying bobbins with different roving qualities, a quality sorting operation can be possible with the color sensor of the invention. As a rule, each transfer unit of the invention is equipped with a respective color sensor. According to a feature of the invention, a central intelligent control unit can be provided for the spinning plant which permits two or more roving frames communicating on the transport member so that only one color sensor need be provided. It transmits its color recognition signal to the control unit which can monitor the position of the transporter and controls the instantaneous position of the roving frame transfer unit. The color recognition signal will not be falsified by a subsequent detection if the color sensor is provided directly ahead or downstream of the transfer station.

The transfer units are thus capable of replacing roving cores in the creel of the ring-spinning machine or in the transporter by full roving bobbins. The color sensors can also be associated with filling sensors which, especially in the case of ring-spinning machine transfer units, can trigger a bobbin change or bobbin replacement operation.

The detection of a color or roving quality is only sensible when an empty roving core can be detected or the detected color/roving quality is to be used for some purposes. In an advantageous embodiment of the invention, the filling sensor and color sensor are independent from one another with one of the two sensors leading and the other of the two sensors trailing in the direction of movement of the transporter therepast. When the filling sensor and color sensor are independent from one another and one is located ahead of the other, the downstream sensor can be activated in response to a signal from the upstream sensor triggering the quality determination. Either the color sensor or the filling sensor may be the upstream sensor in this system.

According to the invention a single color sensor can be used and, especially for the roving frame transfer unit, only a single filling sensor need be provided. In the latter case it has been found to be advantageous to combine a color sensor and filling sensor into a single sensor unit.

When an independent central control unit is provided and the actual setting of the transport unit is continuously known to the central controller, roving frame transfer units with their own sensors can be eliminated. The color sensors available on the market can clearly distinguish up to six different colors. The color sensor of the invention should be able to recognize as many colors as there are different yarn qualities on the transporter. Alternatively, the color sensor can detect a lesser number of colors and, more preferably, a number equal to the number of roving frames connected to the transporter.

In the case in which a roving frame transfer unit is also to automatically control the changeover of roving quality, the number of colors which can be distinguished should be greater since for each pair of yarn qualities that may be automatically interchangeable in the spinning unit, there must be a further color. The number of roving frames serviced by the transporter and hence the number of yarn qualities or core colors will depend upon the carrying capacity of the transporter, upon the transfer rate of the roving frame transfer unit and the productivity of the roving frames. These factors as a rule need not exceed three. Since a change in yarn quality is only carried out when it cannot be avoided, it is indeed infrequent that changeovers among more than two roving qualities are required and further that a changeover will be necessary at all. The number of ring-spinning machines which are serviced by the transporter has an influence upon the number of roving qualities which may have to be considered since the number of different roving qualities will generally be greater as the number of ring-spinning machines is greater. Stated otherwise, as the number of ring-spinning machines serviced by the transporter increases, the greater is the probability that it will be necessary to provide for interchange between two roving qualities.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
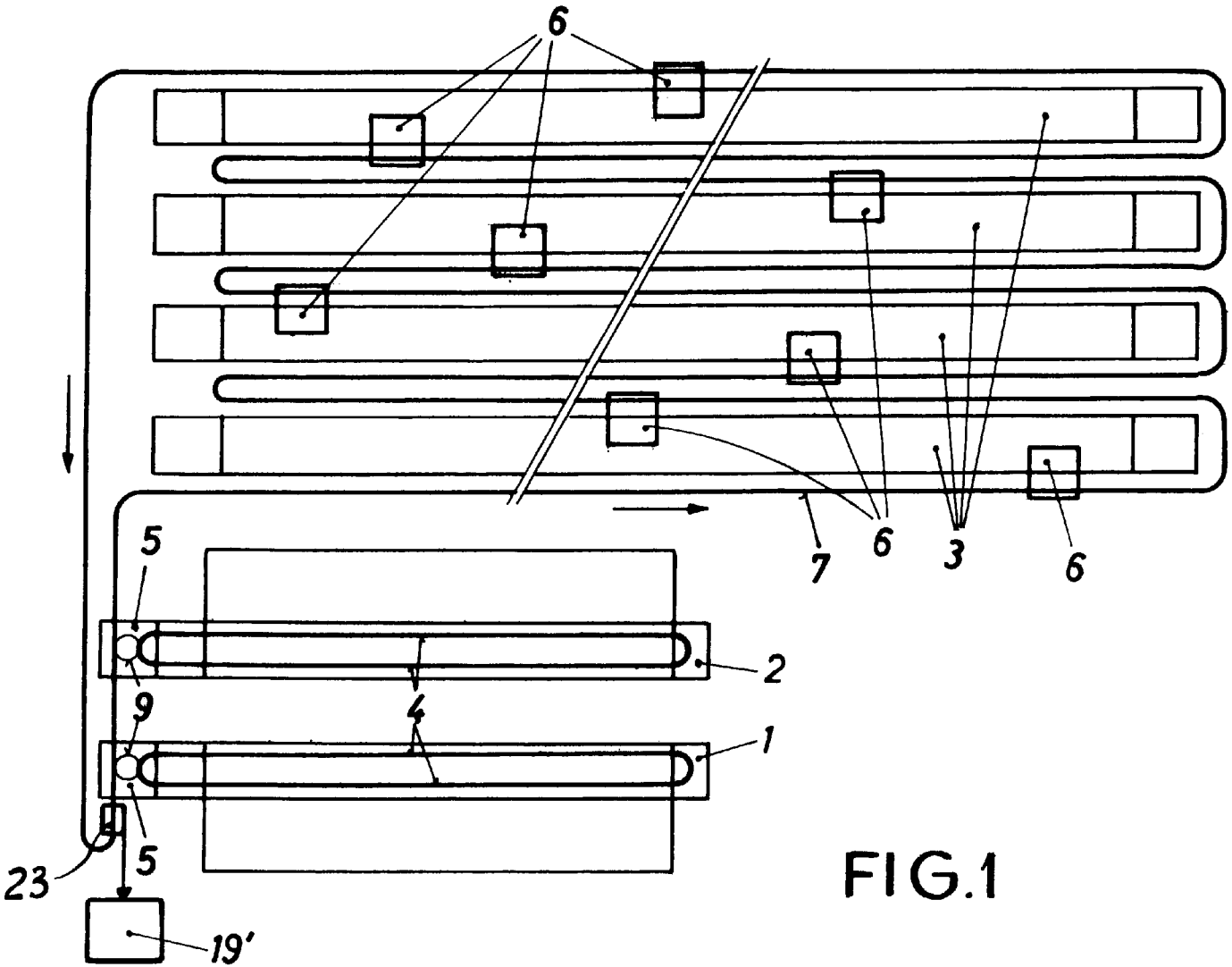
FIG. 1 is a plan view of a spinning plant with two roving frames and a plurality of ring-spinning machines, namely, three.
Figure 5:
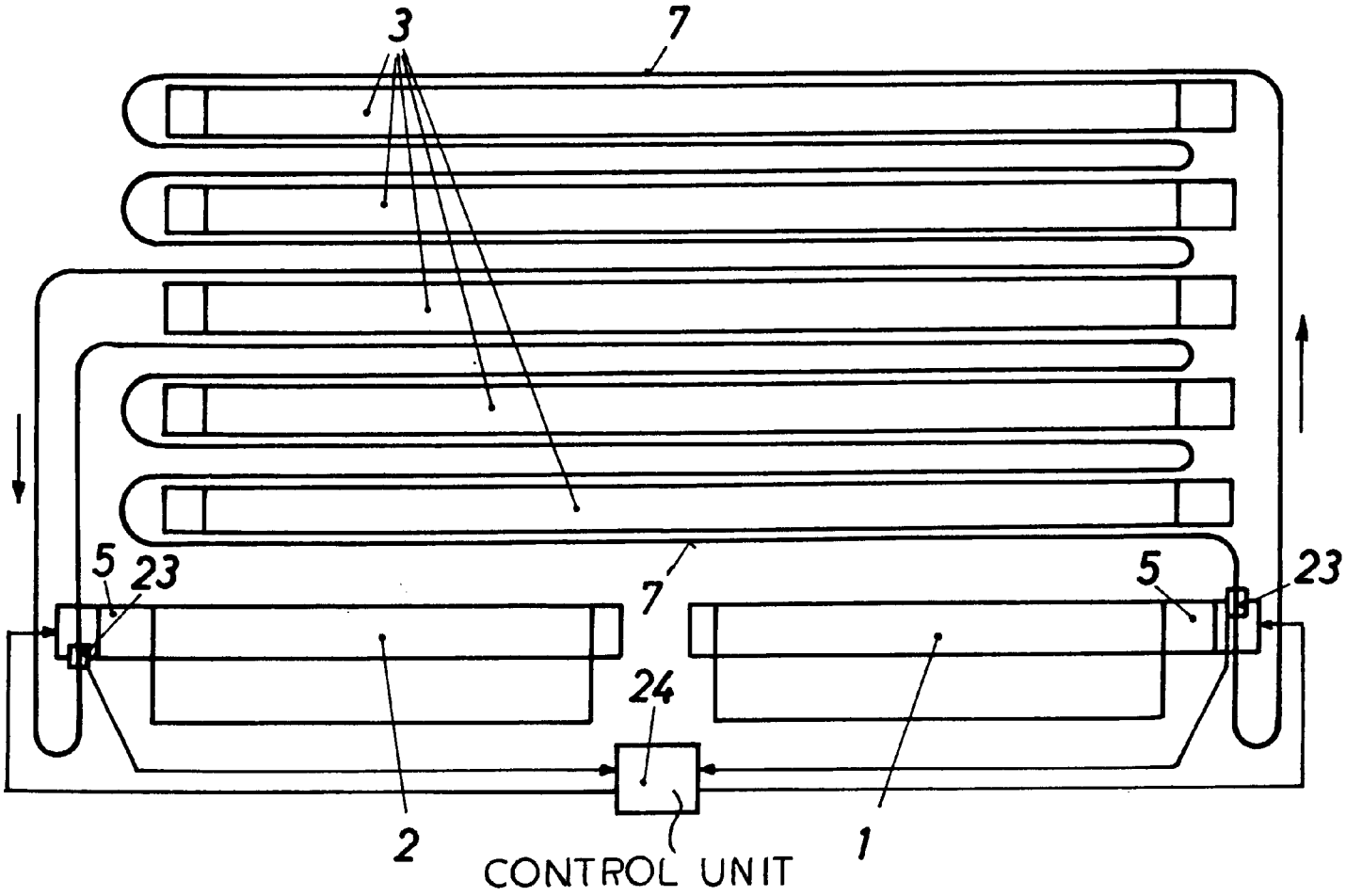
FIG. 5 is a plan view of a variant of the spinning plant having two roving frames and five ring-spinning machines for the single transporter.

As can be seen from FIGS. 1 and 5, the spinning plant of the invention can comprise a plurality of roving frames 1 and 2 and a multiplicity of ring-spinning machines 3. The invention is also applicable to spinning plants which can have as few as one roving frame and a number of ring-spinning machines. Each of the roving frames can be provided with two or more rows of spindles and each spindle can form a roving winding station in which, on a previously empty core or sleeve, a roving can be wound to form the full roving bobbin. The sliver for each station can be drawn from sliver cans of a can field associated with the roving frame.

The ring-spinning machines, in turn, can have creels with two or more rows of bobbins and can have two or more rows of working stations, each with a respective spindle. The spindles may be vertically displaceable on spindle rails and cooperate with travelers orbiting the spindles on respective rings. Rings can be vertically displaceable on ring rails. The roving can pass through a drafting frame here as well.

The roving machines 1 and 2 can have a system for automatic replacement of full roving bobbins by empty roving sleeves or cores. Such a system has not been shown in detail but can be of the type described in DE 195 05 050 C24. This device includes a transport unit 4 for each of the roving frames by means of which the full roving bobbins are delivered to the transfer unit 5 and from which empty roving sleeves are received for delivery to the respective roving stations.

Each of the ring-spinning machines 3 can be equipped with transfer units 6 as described in DE 37 34 275 A1 or in DE 39 41 822 C2 and which can be used to receive the empty roving cores or sleeves and can deliver the fully wound roving bobbins to the machines. The transfer units 6 are commonly displaceable along the creel of the ring-spinning machine and can be designed to remove the roving bobbins after they have fully unwound or just before they have fully unwound. In that case, the transfer units 6 can be equipped with means for removing roving residues from the unwound cores or sleeves. In the embodiment illustrated diagrammatically in the drawing, each ring-spinning machine 3 is provided with a respective transfer unit 6 on each side of the creel of the ring-spinning machine. It is possible however to operate with a single transfer unit 6 for each ring-spinning machine in which case the transfer unit at least at one end of the ring-spinning machine can be transferred to the opposite side. In the system of FIG. 5, the requirement of roving bobbins and roving sleeves is effected by service personnel by hand.

Figure 4:
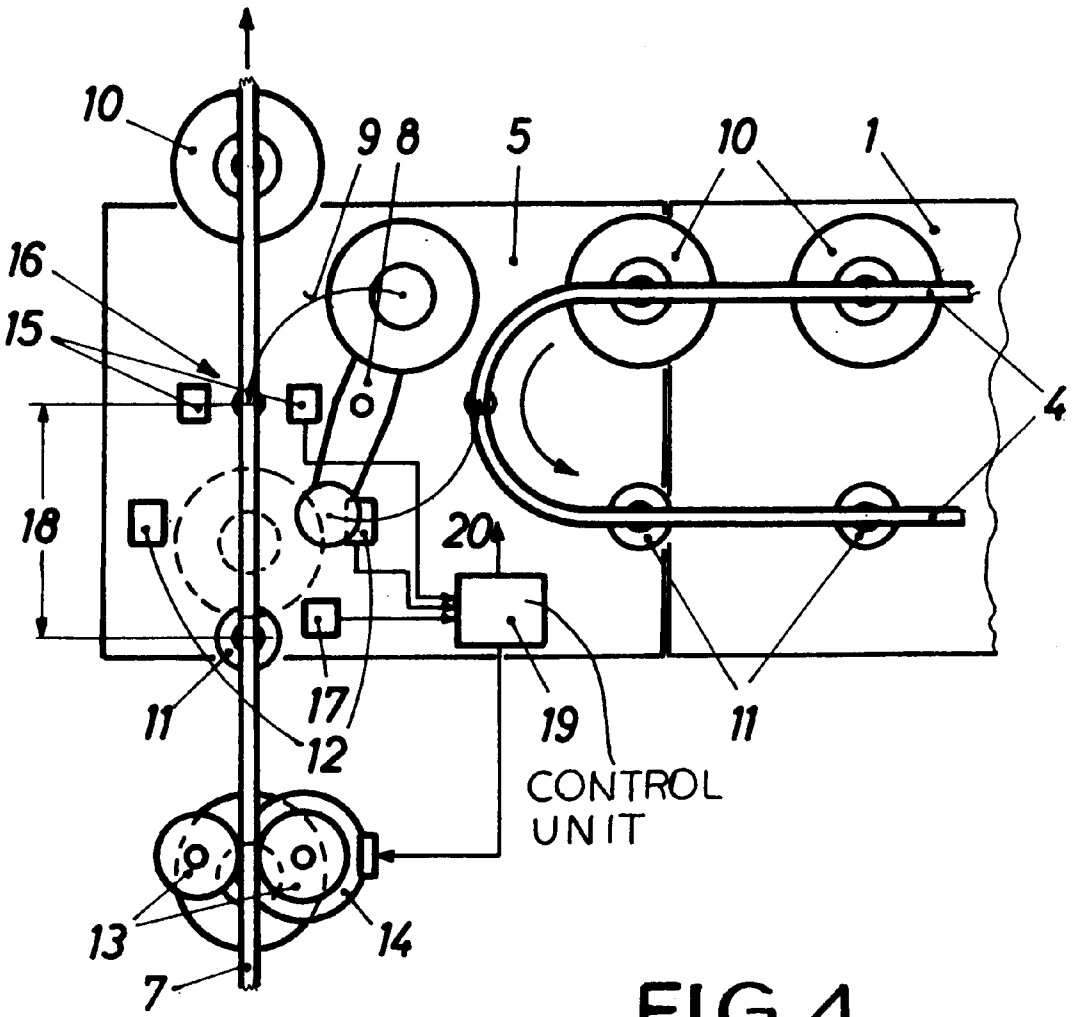
FIG. 4 is a diagram of a control arrangement for controlling the transfer process.

The roving frame transfer unit 5 can be so constructed, as described in DE 197 02 163.8 (U.S. Pat. No. 5,996,327) that it has, as has been shown highly diagrammatically in FIG. 4, sleeve grippers on opposite ends of a rotatable double arm lever 8 which can also be raised and lowered and which effects transfer as the hangers for the sleeves and the bobbins are displaced along an arcuate path on the transport unit 4. The circular path of the lever 8 has been represented at 9. This circular path 9 is tangential to the transporter 7 and to the conveyer 4 so that the core gripper of the arm 8 can transfer a full bobbin to the empty hanger of the transporter 7 after the other core gripper at the end of the arm 8 has removed an empty core therefrom and transferred the same to a hanger on the conveyer 4.

The transfer units 5 of the roving frames 1 and the transfer units 6 displaceable along the creels of the ring-spinning machines 3, in the system of FIG. 1, cooperate with the endless transporter 7 which may be formed as a chain riding in a closed rail system and having at spaced apart locations therealong hangers in which the full roving bobbins and the empty core sleeves can be automatically engaged or from which they can be disengaged, or in which the roving bobbins and core sleeves can be affixed or removed by hand.

Both the roving machine transfer units 5 and the ring-spinning machine transfer units 6 have filling sensors, preferably formed as light beam interruption sensors which can detect the empty hangers, the full bobbins or the empty sleeves on the transporter 7. The filling sensors 12 are located at the level of the turns of the roving bobbins 10 but below the hangers of the transporter. The ring-spinning machine transfer units have further filling sensors which can recognize empty or approximately empty supply bobbins in the creel of the ring-spinning machine 3. Since these filling sensors are not important for the understanding of the invention, they have not been further described or illustrated. The filling sensors 12 can be associated with sensors or detectors which are activated on passing of the hangers of the transporter 7 by the filling sensors. These additional sensing elements can be mechanical sensors or the like. The light-interruption sensors register, upon activation, the passage of empty core sleeves (short interruption) or the passage of a longer interruption (full bobbin) by outputting respective signals. The passage of an empty hanger does not generate a signal for the respective hanger position.

It has been found to be advantageous further to equip each roving machine transfer unit 5 and each ring-spinning machine transfer unit 6 with a position sensor 15 which also can be formed by a light-beam interruption sensor and which is located at a point at which the hangers of the transporter 7 arrive at the changeover location or station 16. The position sensors 15 can be conventional sensors of this type which are not described in greater detail and serve to so control the friction wheel pair 13 propelling the transporter 7 and driven by the motor 14, that each hanger will come to standstill at the location 16 to the extent that a bobbin/core replacement is required.

According to the invention, moreover, the roving frame transfer units 5 and the ring-spinning machine transfer units 6 all have color sensors 17 as light detectors which can recognize the color of a roving core 11 passing the sensor 17. The color sensor 17 is thus located at the level customarily occupied by the cores 11 and the respective hangers and preferably at a level of a portion of the colored core which is not covered by the roving winding, i.e. at the upper or lower end of the core. The color sensor is so constructed that it can distinguish between at least two different colors. As a rule it is sufficient that the color sensor be capable of distinguishing up to six different colors.

The color sensor can be a so-called "intelligent" sensor in that it outputs a signal only when it recognizes a particular color. However, it can also output different signals for all of the colors recognizable by the sensor, these signals being then processed in an intelligent controller to indicate which color has been detected.

It has been found to be advantageous to provide the color sensor 17 of each transfer unit 5 or 6 upstream of the respective filling sensor 12 with respect to the direction of movement of the transporter 7. In this case, the filling sensor 12 and the position sensor 15 will only be activated when a sleeve or core of the correct color, representing a particular quality of the bobbin for the respective roving machine and ring-spinning machine is detected or an empty core sleeve corresponding to the correct quality of the roving is detected or the empty core sleeve corresponding to the correct quality of the roving is detected.

It is, however, also possible to provide each filling sensor 12 upstream of the respective color sensor 17. In this case, the color sensor 17 and the position sensor 15 are only activated when in the case of a roving frame transfer unit 5, an empty roving core 11 or an empty hanger is detected or, in the case of a ring-spinning machine transfer unit 6, a full bobbin 10 is detected.

The color sensor 17 and the filling sensor 12 are advantageously located in a respective first partial field of the hanger on the transporter 7 upstream of the changing location 16. This is the advantage that the signals from the sensors can also be used for control purposes directly. In other cases memories or signal storage must be provided for intermediate storage of the signals until the hanger which is associated with the particular signal reaches the changeover location 16.

Each roving frame transfer unit 5 and each ring-spinning machine transfer unit 6 can include a control unit 19 (FIG. 4) receiving the incoming signals from the color sensor 17, the filling sensor 12 and the position sensor 15, as well as from the bobbin change mechanism of the transfer units and converts these signals into position or controlling signals which are transmitted via line 20 to the changeover mechanism and to the drive 13, 14 of the transporter 7. The functioning of the control unit 19 will be discussed in greater detail below.

Figure 2:
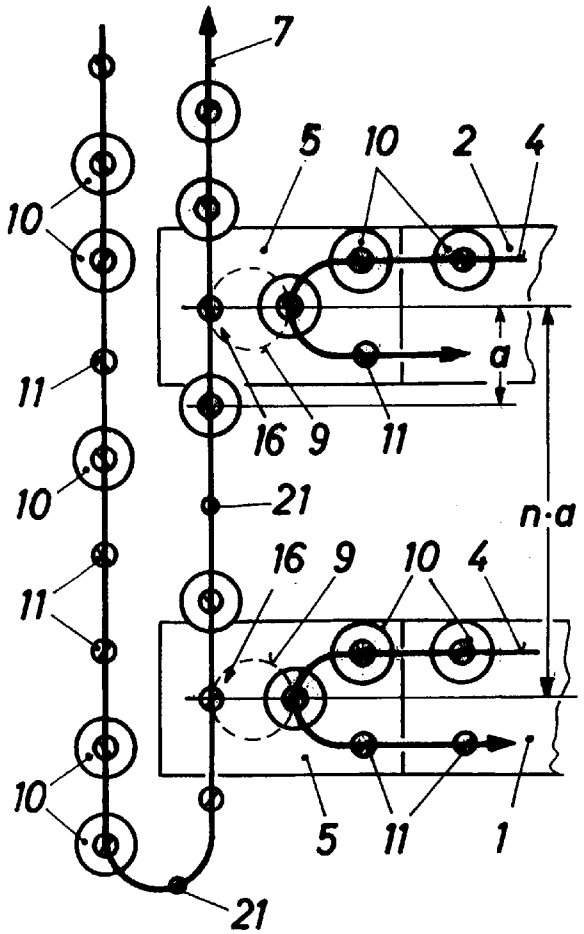
FIG. 2 is a plan view of a portion of the transporter showing the transfer units of two roving frames operating with the single transporter;.

As can be seen from FIG. 2, the transporter 7 which travels in the direction of the arrowhead shown on the transporter 7 is supplied with bobbins or cores in a nonuniform manner. Apart from empty hangers 21, this transporter also carries roving cores 11 or fully wound bobbins 10 both of a quality/color A (circles with slash lines inclined to the right) and those of quality/color B (circles with slash lines inclined to the left). The bobbin of quality A are produced by the roving frame 1 and those of quality B by the roving frame 2.

When the color sensor of the roving frame transfer unit 5 recognizes a sleeve or bobbin of its color/quality, a signal is provided to the control unit 19 of the respective transfer unit and activates the transfer unit in response to a setting signal of the filling sensor 12. When the filling sensor 12 generates a signal representing the presence of an empty core sleeve, the signal is delivered together with a signal activating the bobbin replacement mechanism of the lever 8 carrying a full bobbin 10. The position sensor 15 then signals the arrival of the hanger at the changeover position 16 while the control unit 19 causes the changeover of this sleeve for the corresponding full roving bobbin which is then suspended in the hanger. The transporter 7 is reactivated.

In the case in which the transporter 7 and the unit 4 are not at the same levels in a roving frame 1, 2 or that the sleeve grippers of the double-arm lever 8 cannot be synchronously charged with a new roving bobbin during changeover operation, the changeover mechanism can raise or lower the arm 8 so that the previously removed sleeve 11 is delivered to the transport conveyer 4 of the roving machine and a new bobbin 10 is picked up therefrom.

When the control unit 19 receives no signal as to the presence of a full bobbin 10 and hence a full bobbin 10 is not available for the bobbin change at the roving frame transfer unit 5, the position signal of the sensor 15 is omitted and no signal is delivered to the drive 13. The drive is then not stopped. Only when the transport conveyer 14 of one of the roving machines 1, 2 is in a position to deliver roving bobbins is a bobbin change initiated. The control unit 19 can be so programmed that the full bobbins are introduced not only into hangers from which sleeves have been removed but also in empty hangers 21.

For a bulk change, the control unit 19 can be so programmed that it enables the transfer unit 5 to be supplied with roving bobbins of a new quality/color upon detection of roving bobbins or cores of another quality/color when a changeover of roving quality is to be effected and can control whether hangers are to be supplied with roving bobbins or empty hangers are to be provided with roving bobbins as the program may require.

Figure 3:
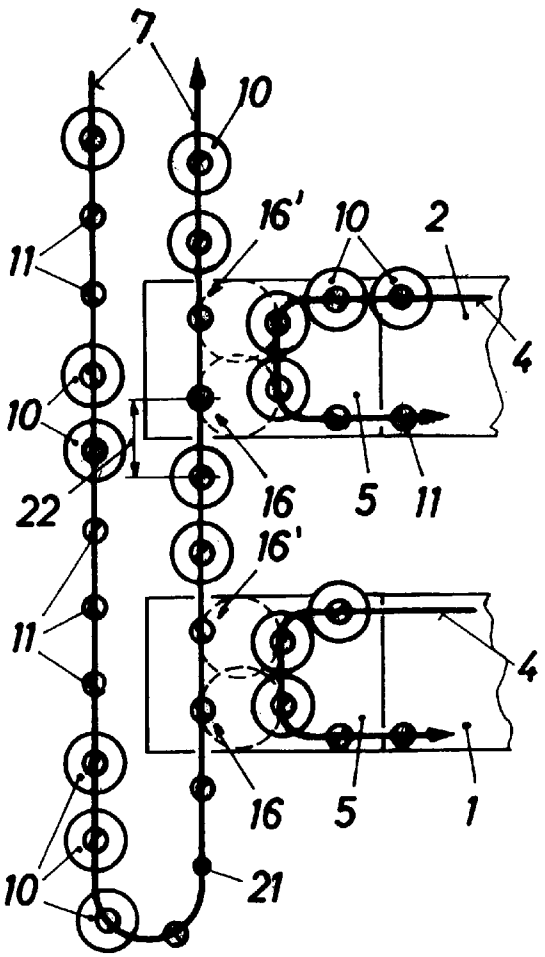
FIG. 3 is a view similar to FIG. 2 in which two bobbins can be replaced at a time by each transfer unit of the two roving frames associated with the common transporter.

In many cases it is advantageous to carry out a bobbin/core replacement in the transfer unit as has been shown diagrammatically in FIG. 3 in which each of the transfer units can simultaneously remove two roving bobbins from the respective conveyer 4 of one or the other of the roving frames 1, 2 and transfer them in succession or simultaneously to two successive hangers of the transporter 7. In this case, each of the transfer units 5 has two transfer positions 16, 16', each of which is serviced by a respective double-arm lever 8. The transporter 7 is then advantageously so mounted with the core sleeves and roving bobbins that a changeover of pairs of successive bobbins or cores are effected with the same quality/color, along the transporter.

The color sensor 17 and the filling sensor 12 may be in the second hanger partial field 22 ahead of the first changeover position 16 in the direction of travel of the transporter 7. They can, in this manner, determine whether two successive hangers are provided with empty cores and simultaneously can be removed and replaced by two full bobbins of the same quality. When this is not the case, the transfer unit 5 is so constructed and its controller 19 so controlled that individual bobbins and cores can be transferred at one of the positions 16, 16'.

It is advantageous to provide a multiplicity of such roving frames 1, 2 or a multiplicity of the transfer positions 16, 16' with such a spacing from one another that the spacing is equal to a multiple n*a (n=2, 3, 4 . . . ) of the pitch a of the hangers along the transporter 7. In this case, when there is a standstill of the transporter 7, a plurality of transfer units can be simultaneously operated with a considerable saving in time.

In the case in which roving frames 1, 2 usually supply roving of the same quality, it is advantageous to so operate the transporter 7 that the transfer positions of the roving frame transfer units 5 is at a fractional spacing whose denominator is determined by the number of roving frames supporting the transporter. In the case of two roving frames, for example, this spacing can be half the length of the transporter as has been shown in FIG. 5. In this manner an approximately uniform mounting of the bobbins/cores on the transporter 7 can be achieved over its entire length.

In the case in which only roving frames of a single quality are to be carried by the transporter 7, the color sensor 17 can be deactivated. However, it has been found to be practical even in this case to maintain the color sensor 17 active since it cannot be excluded that a bobbin 10 or roving core 11 of a "false" color/roving quality may have been mounted on the transporter.

When the roving quality at one of the roving frames 1, 2 is to be changed, the roving bobbins of the previous roving quality are removed from the transporter 7 rapidly and replaced by the roving bobbins of the new roving quality. For this purpose, the controller 19 can be so programmed that the roving frame transfer unit 5 will remove both roving bobbins 10 and roving cores 11 of the previous roving quality/color without supplying roving bobbins or roving cores or supplying only roving bobbins or roving cores of the new roving quality. The removed roving bobbins 10 and roving cores 11 of the previous roving quality naturally should not be fed to the transport conveyers and can be separately stored.

The transfer operation of the transfer unit 5 must be configured for this type of operation as well. The function of the ring spinning transfer units 6 differs from that of the transfer units 5 or the roving frames in that the transfer units 6 usually patrol along the creel of the ring-spinning machine and look for empty roving sleeves or roving cores in the creel which will soon be emptied. When a ring-spinning machine transfer unit detects such a roving core or sleeve in the creel, it halts and the bobbin change operation is effected. In this case as well, its color sensor, which has been activated and its filling sensor 12 which is activated thereby (or vice versa) detect the color roving quality of the degree of filling of the core as the transfer unit is passed by the transporter 7. When the transfer unit detects a roving bobbin 10 of the "correct" quality, a transfer is effected between the empty core on the creel and the correct roving bobbin on the transporter by the then stationary transfer unit. The controller can bring the transfer unit and its drive 13, 14 to standstill and can issue the signal to the transfer device to effect the bobbin change operation. Following the bobbin change operation, the transporter 7 is again set in notion and the transfer unit permitted to patrol further.

When, as has been shown in FIG. 1, the positions at which the interchange of bobbins and cores is to take place (corresponding to the positions 16 and 16' in FIGS. 2 and 3) of two or more roving frames 1, 2 are located sufficiently close together, only one color sensor 17 need be provided for a plurality of roving frame transfer units 5 along the transporter 7. In that case only a single filling sensor 12 is required as well.

Since there is close cooperation between the filling sensors 12 and the color sensors 7 in the sense that one may be activated by the other and one may be downstream of the other with a close spacing between the two, the color sensor 17 and the filling sensor 12 of a transfer unit 5 or 6 can be assembled together in a single sensor unit as has been represented at 23 in FIG. 5, for example. In that case the control unit need not be a control unit as shown at 19, but rather can be a control unit such as has been indicated at 24, common to all of the sensor units 23.

Spinning machines generally have an intelligent central controller which monitor the operations of the spinning machine and can be connected to an intelligent central controller for the entire spinning plant which coordinates the spinning machines with the transporter and the roving frames. With the system of the invention, the control units 19 represent a certain degree of decentralization of this type of control and when such central control units are provided, as has been represented at 24, the decentralized controllers 19 can be eliminated since the central controller can then take over the control of the bobbin/core transfer process. The central control unit 24 can thus receive the color signals from all of the color sensors 17 and thus can monitor the positions of the various qualities of the roving along the transporter 17. When the signals indicating the positions of the appropriate hangers at the changeover locations 16, 16' for the correct transfer unit 15 for a particular roving quality, the respective filling sensors are activated and depending upon the signal generated by the filling sensor, the replacement operation can be effected.

Since the changeover is color dependent, the transporter 7 can carry roving bobbins of at least two different yarn qualities and the invention can ensure:

that a roving machine is supplied only with roving-receiving cores of the respective color corresponding to the roving quality to be produced and thus each roving quality is wound only on roving bobbins of the correct color;

that each position along the transporter 7 carrying a roving bobbin receives only the roving bobbins of the same quality, thereby maintaining the distribution along the transporter quantitatively and in a positionally correct sense for the different roving qualities; and that a ring-spinning machine is only supplied with roving bobbins of the appropriate color and roving quality intended for that ring-spinning machine.

False mounting of bobbins or sleeves of another roving quality is avoided even when the transfer to and from the transporter is effected by hand. A transfer unit delivers only the correct roving cores to its roving frame and mounts only roving bobbins of the correct roving quality on the transporter.

The term "quality" has been used here to refer to any characteristic of a roving which may distinguish it from another. It is intended to include fineness, material, composition, mixing ratio of the fibers, color and the like. Problems with changeover to other yarn qualities are eliminated and accidents with respect to improper yarn quality within a spinning operation and problems with the finished product are eliminated entirely.

What is claimed is:

1. A spinning plant comprising:

at least one roving frame having a multiplicity of stations for forming roving from sliver and winding roving onto a respective core sleeve at each of said stations and form a respective roving bobbin;

at least one ring spinning frame having a multiplicity of stations for spinning roving from said bobbins into yarn and emptying roving from the core sleeves of said bobbins;

an endless transport element extending in a closed path between said at least one roving frame and said at least one ring spinning station for carrying roving bobbins to said ring spinning frame from said roving frame and for returning empty core sleeves from said ring spinning frame to said roving frame, said empty core sleeves having one of a plurality of different colors representing different roving qualities of roving bobbins to be wound thereon;

at least one automatic transfer unit along said path and provided with means for exchanging core sleeves and roving bobbins on said transport element for empty core sleeves; and at least one color sensor along said path for automatic scanning of said empty core sleeves for color and, in dependence upon a detected color, controlling operation of said transfer unit, and at least one filling sensor for distinguishing between substantially full roving bobbins, substantially empty core sleeves and empty hanger positions of said transport element and controlling said at least one automatic transfer unit upon actuation by said color sensor, said color sensor being located upstream of said filling sensor with respect to the direction of movement of said roving bobbins and core sleeves along said path, said color sensor activating said filling sensor.

2. The spinning plant defined in claim 1 wherein each of said frames is provided with a respective one of said automatic transfer units and each of said automatic transfer units is provided with a respective one of said color sensors for controlling the respective transfer unit.

3. The spinning plant defined in claim 1 wherein each of said frames is provided with a respective one of said automatic transfer units and a central controller is provided for said frames, said transport element and said automatic transfer units, said color sensor being connected to said controller for operating at least one of said transfer units in response to detection of color of said core sleeves.

4. The spinning plant defined in claim 1 wherein said color sensor is capable of distinguishing between n different colors, whereby n is the number of roving frames serviced by said transport element.

5. The spinning plant defined in claim 1 wherein said color sensor is capable of distinguishing between n+m different colors, whereby n is the number of roving frames serviced by said transport element and m is the number different roving qualities capable of being simultaneously processed in the plant.

6. A spinning plant comprising:

at least one roving frame having a multiplicity of stations for forming roving from sliver and winding roving onto a respective core sleeve at each of said stations and form a respective roving bobbin;

at least one ring spinning frame having a multiplicity of stations for spinning roving from said bobbins into yarn and emptying roving from the core sleeves of said bobbins;

an endless transport element extending in a closed path between said at least one roving frame and said at least one ring spinning station for carrying roving bobbins to said ring spinning frame from said roving frame and for returning empty core sleeves from said ring spinning frame to said roving frame, said empty core sleeves having one of a plurality of different colors representing different roving qualities of roving bobbins to be wound thereon;

at least one automatic transfer unit along said path and provided with means for exchanging core sleeves and roving bobbins on said transport element for empty core sleeves; and at least one color sensor along said path for automatic scanning of said empty core sleeves for color and, in dependence upon a detected color, controlling operation of said transfer unit at least one filling sensor for distinguishing between substantially full roving bobbins, substantially empty core sleeves and empty hanger positions of said transport element and controlling said at least one automatic transfer unit activation of said color sensor, said filling sensor being located upstream of said color sensor with respect to the direction of movement of said roving bobbins and empty core sleeves along said path and being connected to said color sensor for activating same.

7. The spinning plant defined in claim 1, further comprising at least one filling sensor capable of distinguishing between substantially full roving bobbins, substantially empty core sleeves and empty hanger positions of said transport element and controlling said at least one automatic transfer unit upon activation by said color sensor, said color sensor and said filling sensor being integrated into a common sensor unit.

8. A method of operating a spinning plant comprising:

at least one roving frame having a multiplicity of stations for forming roving from sliver and winding roving onto a respective empty core sleeve at each of said stations and form a respective roving bobbin;

at least one ring spinning frame having a multiplicity of stations for spinning roving from said bobbins into yarn and emptying roving from the core sleeves of said bobbins;

an endless transport element extending in a closed path between said at least one roving frame and said at least one ring spinning station for carrying roving bobbins to said ring spinning frame from said roving frame and for returning empty core sleeves from said ring spinning frame to said roving frame, said empty core sleeves having one of a plurality of different colors representing different roving qualities of roving bobbins to be wound thereon;

at least one automatic transfer unit along said path and provided with means for replacing roving bobbins on said transport element with empty core sleeves; and at least one color sensor along said path for automatic scanning of said empty core sleeves for color and, in dependence upon a detected color, controlling operation of said transfer unit, said method comprising the steps of:

(a) advancing each hanger position of said transport element from which a full roving bobbin or an empty core sleeve can be suspended to arrive in sequence at a sensing station;

(b) upon arrival of each hanger position at said sensing station, detecting with said color sensor whether an empty core sleeve of a certain color or a roving bobbin of a certain roving quality has arrived; and (c) thereafter activating a filling sensor of a respective automatic transfer unit to control operation of the transfer unit.

9. A method of operating a spinning plant comprising:

at least one roving frame having a multiplicity of stations for forming roving from sliver and winding roving onto a respective empty core sleeve at each of said stations and form a respective roving bobbin;

at least one ring spinning frame having a multiplicity of stations for spinning roving from said bobbins into yarn and a emptying roving from the core sleeves of said bobbins;

an endless transport element extending in a closed path between said at least one roving frame and said at least one ring spinning station for carrying roving bobbins to said ring spinning frame from said roving frame and for returning empty core sleeves from said ring spinning frame to said roving frame, said empty core sleeves having one of a plurality of different colors representing different roving qualities of roving bobbins to be wound thereon;

at least one automatic transfer unit along said path and provided with means for exchanging core sleeves and roving bobbins on said transport element; and at least one color sensor along said path for automatic scanning of said empty core sleeves for color and, in dependence upon a detected color, controlling operation of said transfer unit, said method comprising the steps of:

(a) detecting for each hanger position with a filling sensor capable of distinguishing between full roving bobbins, empty core sleeves and empty hanger positions, whether the respective hanger position has an empty core sleeve; and (b) thereafter activating the color sensor which is located downstream of the filling sensor in a direction of displacement of said transport element when an empty core sleeve is in the respective hanger position.

* * * * *